US006955567B2

(12) United States Patent
Inaba et al.

(10) Patent No.: US 6,955,567 B2
(45) Date of Patent: Oct. 18, 2005

(54) JUNCTION TERMINAL AND CONNECTOR HAVING THE SAME

(75) Inventors: Shigemitsu Inaba, Shizuoka (JP); Katsuhiko Onoda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/707,796

(22) Filed: Jan. 13, 2004

(65) Prior Publication Data

US 2004/0166744 A1 Aug. 26, 2004

(30) Foreign Application Priority Data

Feb. 18, 2003 (JP) ..... 2003-039632

(51) Int. Cl.[7] ..... H01R 25/00
(52) U.S. Cl. ..... 439/651; 439/76.2; 439/852
(58) Field of Search ..... 439/651, 653, 439/843, 852, 76.2, 949

(56) References Cited

U.S. PATENT DOCUMENTS 1,906,976 A * 5/1933 Lazarus ..... 200/51.03
3,242,455 A * 3/1966 Horvath et al. ..... 439/105
4,090,769 A * 5/1978 Damsky ..... 439/650
4,703,397 A * 10/1987 Minoura et al. ..... 361/826
4,915,637 A * 4/1990 Ogawa et al. ..... 439/76.2
5,129,841 A * 7/1992 Allina et al. ..... 439/517
5,764,487 A * 6/1998 Natsume ..... 361/775
6,379,195 B1 * 4/2002 Torikoshi et al. ..... 439/733.1

FOREIGN PATENT DOCUMENTS

JP 11-55892 2/1999

* cited by examiner

*Primary Examiner*—Hien Vu
(74) *Attorney, Agent, or Firm*—Armstrong, Kratz, Quintos, Hanson, & Brooks, LLP.

(57) ABSTRACT

A junction terminal is accommodated in a connector housing to connect a pin terminal fitted on a case of an electric instrument with a receptacle terminal of a wiring harness connector. The junction terminal includes a female electrical contact portion to electrically connect with the pin terminal of the electric instrument, a male electrical contact portion to electrically connect with the receptacle terminal of the wiring harness connector, and a bridging portion to connect the female electrical contact portion with the male electrical contact portion. The male electrical contact portion is constructed so as to be correctly positioned by a positioning member attached to the connector housing. The male electrical contact portion is arranged such that a first longitudinal line passing an intermediate point of the male electrical contact portion aligns with a second longitudinal line passing an intermediate point of the female electrical contact portion.

5 Claims, 5 Drawing Sheets

JUNCTION TERMINAL AND CONNECTOR HAVING THE SAME

BACKGROUND OF THE INVENTION

1. Field of the Invention

The present invention relates to a junction terminal and a connector accommodating the junction terminal. The junction terminal connects a pin terminal fitted on a case of an electric instrument with a receptacle terminal of another connector used, for example, for connection of a wiring harness.

2. Related Art

An automotive vehicle has various kinds of electric instruments mounted thereon. Thus, the vehicle is arranged with wiring harnesses for supplying electrical signals and electrical powers to the instruments. Each wiring harness has a plurality of electrical cables and a plurality of connectors fitted to the electrical cables.

Particularly, an electric or hybrid car has electric instruments such as a motor and an electronic control unit. Each of the electric instruments has a case made of a synthetic resin material and various types of electronic components accommodated in the case. The electric instrument has a pin terminal fitted on the case for electrical connection with a wiring harness. The pin terminal is configured in a plate or a bar and has one end positioned in the case for electrical connection with on one of the electrical components and the other end positioned outside of the case for electrical connection with the wiring harness.

The wiring harness has a connector for electrical connection with the electric instrument. The connector has a receptacle terminal and a box-shaped connector housing accommodating the receptacle terminal.

For electrical connection of the electric instrument and the wiring harness, some types of connectors are used. One of them is disclosed in Japanese Patent Application Laid-open NO. H. 11-55892. As illustrated in FIGS. 9A and 9B, a prior art connector 100 has a connector housing 102 and a tab 101 attached therein. The tab 102 is made from an electrically conductive metal plate. The connector also has a junction terminal 103 accommodated in the connector housing 102.

The connector housing 102 is made of an insulating synthetic resin material to be defined in a box shape. The connector housing 102 has an engagement body 106 coupled with a case 105 of an electric instrument 104. The connector housing 102 also has a harness coupling portion (not shown) to engage with a connector of the wiring harness. The tab 101 has one end positioned in the engagement body 106 and the other end positioned within the harness coupling portion. The junction terminal 103 is accommodated in the engagement body 106 of the connector housing 102. The junction terminal 103 has a pair of female contact portions 107.

The female contact portion 107 has a bottom plate 108 and a pair of resilient contact pieces 109 each contiguous with each side end of the bottom plate 108. The female contact portion 107 pinches a pin terminal 110 or a tab 101 of the electric instrument 104 between the bottom plate 108 and the resilient contact pieces 109. The female contact portion 107 has the pair of resilient contact pieces 109 that press the pin terminal 110 or tab 101 against the bottom plate 108 so that the bottom plate 108 electrically connects with the pin terminal 110 or tab 101. That is, the resilient deformation of the female contact portion 107 can connect itself with the pin terminal 110 or tab 101.

Thus configured connector 100 accommodates the junction terminal 103 in the engagement body 106, and the female contact portion 107 of the junction terminal 103 electrically connects with an end of the tab 101. The engagement body 106 couples with the case 105 of the electric instrument 104, and the other of the female contact portions 107 of the junction terminal 103 electrically connects with the pin terminal 110 of the electric instrument 104. Furthermore, the harness coupling portion engages with a connector of the wiring harness, and the other end of the tab 101 electrically connects with a pin terminal of the wiring harness connector. Accordingly, the connector 100 electrically connects the electric instrument with the wiring harness electrically and mechanically.

The conventional connector 100 has three contact portions, one of which is between the pin terminal 110 of the electric instrument 104 and the female contact portion 107 of the junction terminal 103; a second one is between the female contact portion 107 of the junction terminal 103 and the tab 101; and a third one is between the tab 101 and a receptacle terminal of the wiring harness connector. In view of sure electrical connection, an increased number of contacts are disadvantageous.

The conventional connector 100 requires the tab 101 and the junction terminal 103 for electrical connection of the electric instrument 104 with the wiring harness, which increases parts in number. The connector 100 also needs a member for positioning and holding of the junction terminal 103 within the connector housing 102. The increase of parts causes an increased assembling man-hour, resulting in a higher manufacturing cost.

Furthermore, the connector 100 has the female contact portion 107 of the junction terminal 103 which resiliently deflects to electrically connect with the pin terminal 110 or tab 101. However, the female contact portion 107 of the junction terminal 103 may possibly deviate when the junction terminal 103 is engaged with the tab 101 within the connector housing 102. This is disadvantageous for sure electrical connection of the junction terminal 103 with the tab 101.

Particularly, when the connector 100 is used for a motor which is one of the electric instruments 104 to supply an electrical power to the motor for rotation thereof, a comparatively larger frictional force is needed between the female contact portion 107 of the junction terminal 103 and the tab 101. Thus, the connector 100 may possibly cause unreliable electrical connection between the female contact portion 107 and the tab 101.

SUMMARY OF THE INVENTION

In view of the above-mentioned circumstances, an object of the invention is to provide a junction terminal and a connector having the junction terminal, which do not increase contacts and parts in number and also allows reliable electrical connection between an electric instrument and a wiring harness.

For achieving the object, a first aspect of the invention is a junction terminal accommodated in a connector housing to connect a pin terminal fitted on a case of an electric instrument with a receptacle terminal of a wiring harness connector. The junction terminal includes:

a female electrical contact portion to electrically connect with the pin terminal of the electric instrument, a male electrical contact portion to electrically connect with the receptacle terminal of the wiring harness connector, and a bridging portion to connect the female electrical contact portion with the male electrical contact portion.

Preferably, the male electrical contact portion is constructed so as to be correctly positioned by a positioning member attached to the connector housing. In addition, the male electrical contact portion is arranged such that a first longitudinal line passing an intermediate point of the male electrical contact portion aligns with a second longitudinal line passing an intermediate point of the female electrical contact portion.

A second aspect of the invention is a connector that includes a connector housing, a junction terminal accommodated in the connector housing. The junction terminal connects a pin terminal fitted on a case of an electric instrument with a receptacle terminal of a wiring harness connector. The junction terminal has a female electrical contact portion to electrically connect with the pin terminal of the electric instrument, a male electrical contact portion to electrically connect with the receptacle terminal of the wiring harness connector, and a bridging portion to connect the female electrical contact portion with the male electrical contact portion. Preferably, the male electrical contact portion is constructed so as to be correctly positioned by a positioning member attached to the connector housing. The male electrical contact portion is arranged such that a first longitudinal line passing an intermediate point of the male electrical contact portion aligns with a second longitudinal line passing an intermediate point of the female electrical contact portion.

In the first and second aspects of the invention, the junction terminal has the pair of electrical contact portions, one of which is of a male type. Thus, the male electrical contact portion electrically connects to a receptacle terminal of the wiring harness connector, while the female electrical contact portion of the junction terminal electrically connects to the pin terminal of the electric instrument. The electrical connection between the electric instrument and the wiring harness only requires an electrically conductive member that is the junction terminal. This is advantageous to decrease electrical parts in number, allowing a decreased assembling man-hour and a decreased cost thereof.

Furthermore, the male contact portion of the junction terminal is correctly positioned by the positioning member fitted on the connector housing. The male electrical contact portion resiliently deflects little when the male electrical contact portion of the junction terminal connects to the receptacle terminal of the wiring harness connector. Thus, the male electrical contact portion will keep a correct alignment during connection with the receptacle terminal of the wiring harness connector. This enables sure connection between the male contact portion with the receptacle terminal of the wiring harness connector, allowing reliable electrical connection between the electric instrument and the wiring harness.

The female electrical contact portion of the junction terminal is a barrel-shaped one which can receive a pin terminal therein.

The male electrical contact portion of the junction terminal is a conventional one of a plate or rod shape, which can be received in a corresponding receptacle terminal.

Moreover, the first longitudinal line passing an intermediate point of the male electrical contact portion extends to align with the second longitudinal line passing an intermediate point of the female electrical contact portion. This allows a correct alignment when the male electrical contact portion connects to the receptacle terminal of the wiring harness connector. In addition, when a plurality of the junction terminals are arranged in a depth direction of the connector housing within the housing, a smaller space is required for the housing to allow a compact design of the connector housing.

Preferably, the first longitudinal line passes just the middle of the male electrical contact portion and the second longitudinal passes just the middle of the female electrical contact portion. This will surely keep a correct alignment during connection of the electrical contact portion with the receptacle terminal of the wiring harness connector.

DETAILED DESCRIPTION OF THE PREFERRED EMBODIMENTS

Figure 1:
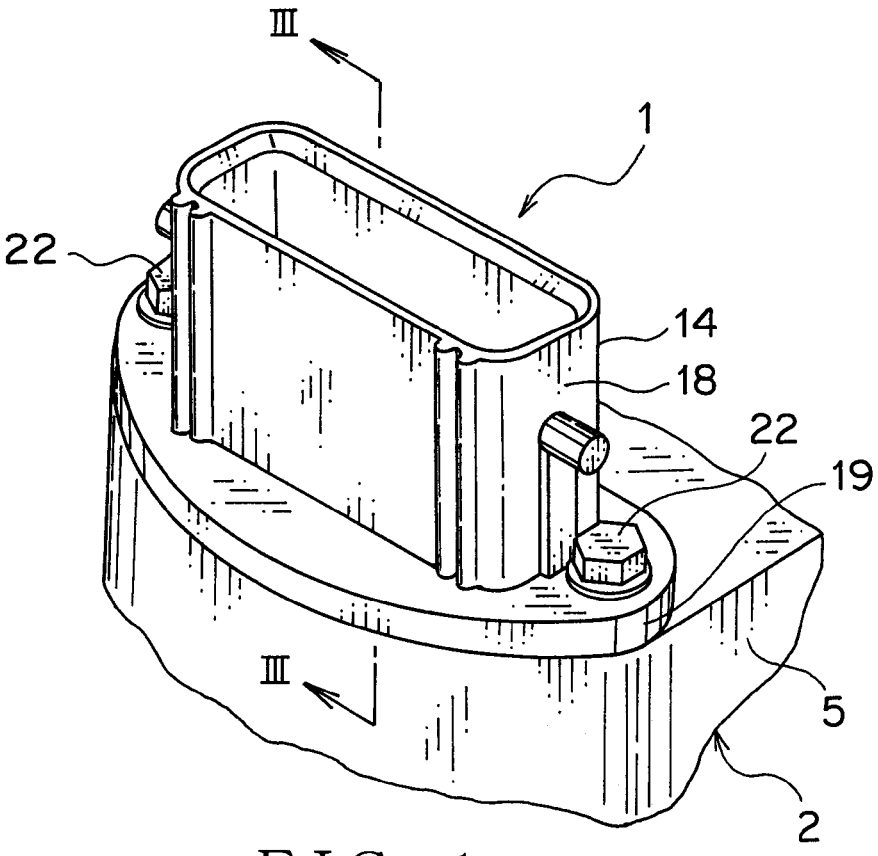
FIG. 1 is a perspective view showing a connector of an embodiment of the present invention, and the connector is attached on a motor.
Figure 2:
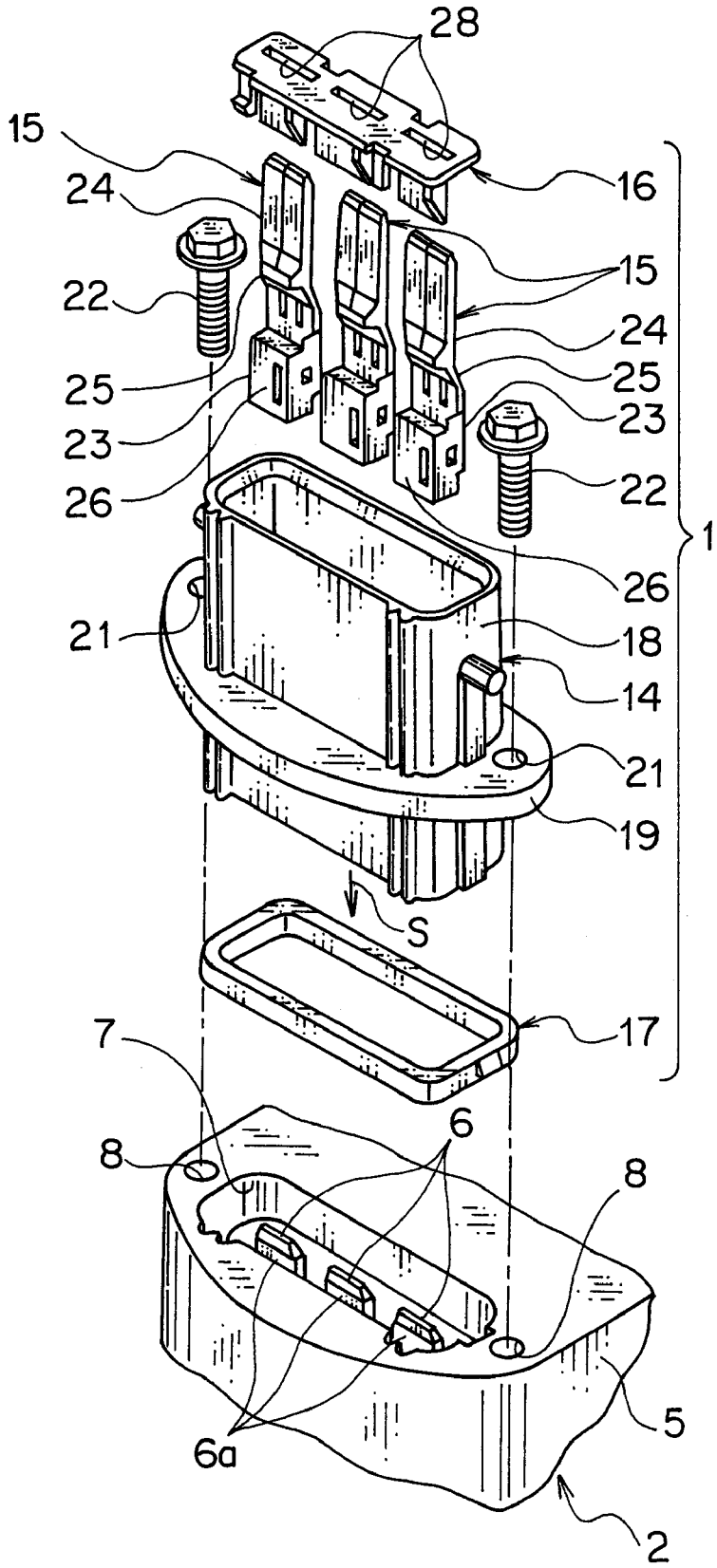
FIG. 2 is an exploded perspective view showing the connector of FIG. 1.

Referring to FIGS. 1 to 8, a junction terminal and a connector having the junction terminal of an embodiment according to the present invention will be discussed hereunder. A connector 1 shown in FIGS. 1 and 2 is fitted on a motor 2 used in an electric car, a hybrid car, or a fuel-cell powered car to engage with a connector 4 of a wiring harness 3 shown in FIG. 8 for supplying an electrical power to the motor 2.

Figure 3:
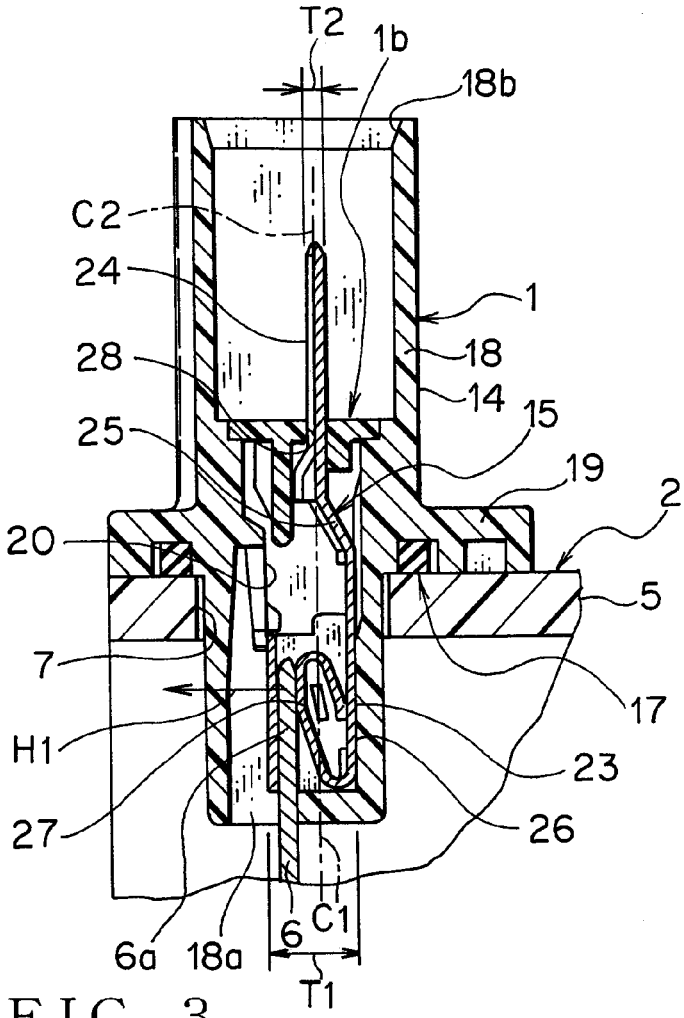
FIG. 3 is a sectional view taken along line III—III of FIG. 1.

The motor 2 is a primary driving unit for moving the car. The motor 2 is a three-phase AC motor. As illustrated in FIGS. 1 to 3, the motor 2 has a case 5 made of a synthetic resin material, electrical components such as a rotor and a stator accommodated in the case 5, pin terminals 6, etc.

The case 5 defines a shell of the motor 2 and has a connector insertion recess 7 (FIG. 2) opened outward. The connector insertion recess 7 is an opening provided in an outer wall of the case 5. The connector insertion recess 7 fits to a profile of a main body 18 of the connector 1. The main body 18 of the connector 1 is inserted into to case 5 through the recess 7.

As illustrated in FIG. 2, the case 5 is formed with a threaded hole 8 that is positioned near the connector insertion recess 7 and receives a bolt 22.

The pin terminal 6 is configured in a plate made of an electrically conductive metal. The pin terminal 6 is fitted on and secured to the case 5 therein. The pin terminal 6 has one end (not shown) for electrical connection with the electrical instrument. The terminal 6 has the other end 6*a* extends longitudinally within the connector insertion recess 7 in an insertion direction of the main body 18 of the connector 1 into the connector insertion recess 7 (shown by an arrow head S in FIG. 2).

Figure 8:
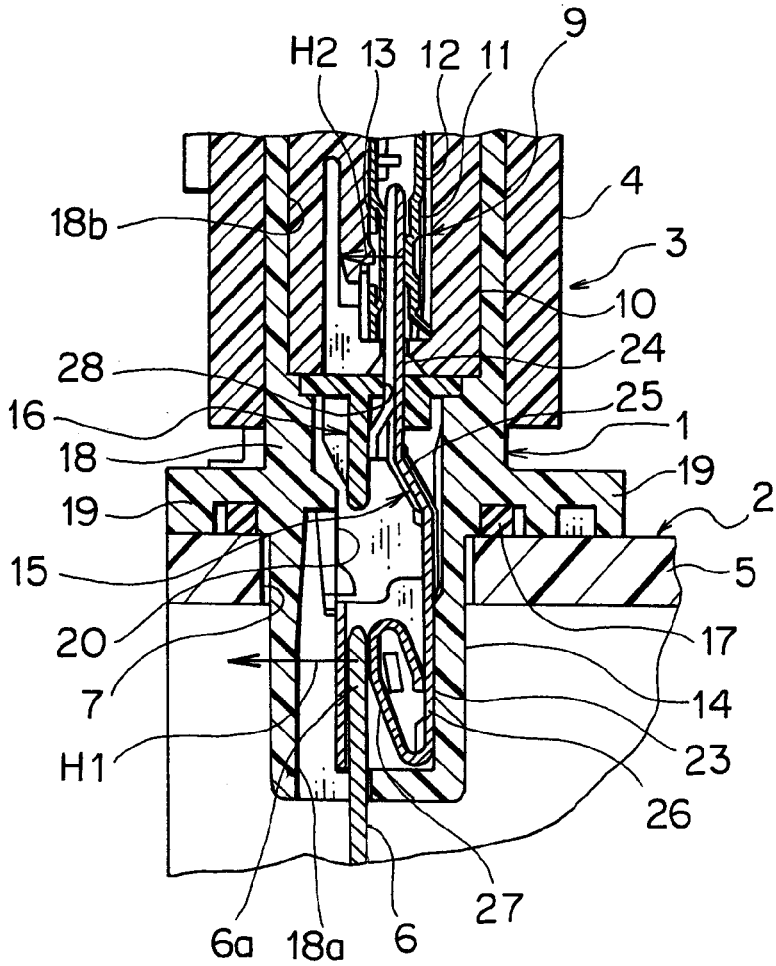
FIG. 8 is a sectional view showing a state in which the connector of FIG. 3 is engaged with a wiring harness connector.

The wiring harness 3 has a plurality of electrical cables and connectors 4. Each electric cable consists of a wire core and an insulating sheath surrounding the core. As illustrated in FIG. 8, the connector 4 has a receptacle terminal 9 and a connector housing 10. The receptacle terminal 9 is made from an electrically conductive metal plate and has unitarily an electrical connection portion (not shown) and an electrical contact portion 11. The electrical connection portion holds the electrical cable and electrically connects to the wire core.

The electrical contact portion 11 has a barrel 12 and a resilient piece 13 received in the barrel 12. The resilient piece 13 resiliently urges a male contact portion 24 of a junction terminal 15 (discussed later) inserted into the barrel 12 against an inner surface of the barrel 12. This electrically connects the electrical contact portion 11 to the junction terminal 15.

As illustrated in FIGS. 1 to 3, the connector 1 has a connector housing 14, a plurality of the junction terminals 15, a positioning piece 16, and a sealing member 17 (particularly shown in FIGS. 2 and 3). The connector housing 14 is a cylindrical main body 18 and a flange 19 which are made of an insulating synthetic resin material.

The main body 18 defines a terminal chamber 20 shown in FIG. 3 to accommodate a plurality of the junction terminals 15. The junction terminals 15 are kept to be electrically isolated from each other. The main body 18 is partially inserted into the case 5 through the connector insertion recess 7 with a one opening 18*a* of the main body 18 headed for the case 5. Through the other opening 18*b*, the connector housing 10 of the connector 4 of the wiring harness 3 is inserted.

The main body 18 engages with the inserted connector housing 10 of the connector 4 of the wiring harness 3, so that a male contact portion 24 (discussed later) of the junction terminal 15 enters the barrel 12 of the electrical contact portion 11 of the receptacle terminal 9 accommodated in the connector 4. Thereby, the junction terminal 15 electrically connects to the receptacle terminal 9.

The flange 19 extends from an outer surface of the main body 18 and is circumferentially contiguous around the main body 18. The flange 19 is formed with a through hole 21. The flange 19 lays on an outer surface of the case 5 when the main body 18 is inserted into the case 5 through the connector insertion recess 7 with the one opening 18*a* headed for the case 5. Meanwhile, the through hole 21 aligns with the threaded hole 8. The bolt 22 is screwed into the threaded hole 8 to secure the connector housing 14 to the case 5.

Figure 4:
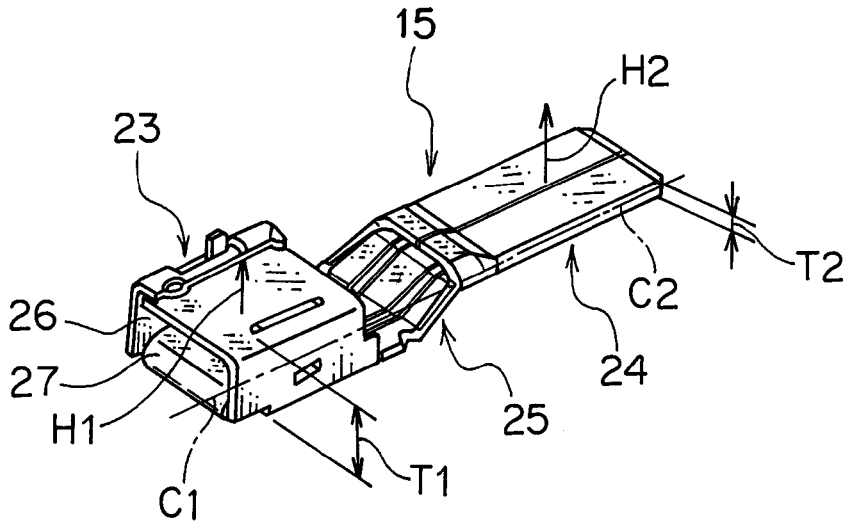
FIG. 4 is a perspective view showing a junction terminal disposed in the connector of FIG. 1.
Figure 5:
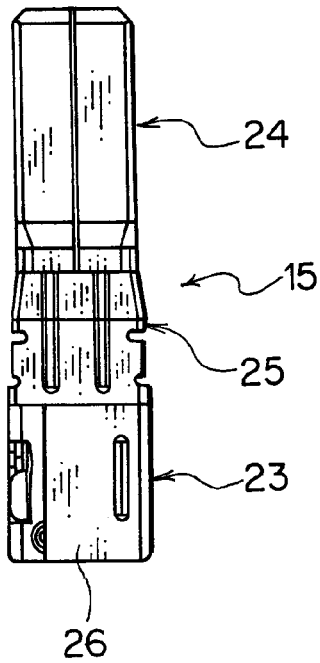
FIG. 5 is a plan view showing the junction terminal of FIG. 4.
Figure 6:
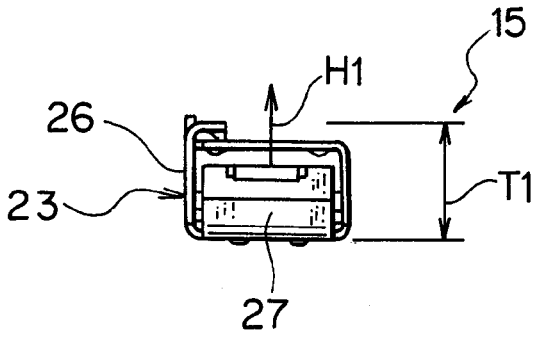
FIG. 6 is the front view showing the junction terminal of FIG. 4.
Figure 9A:
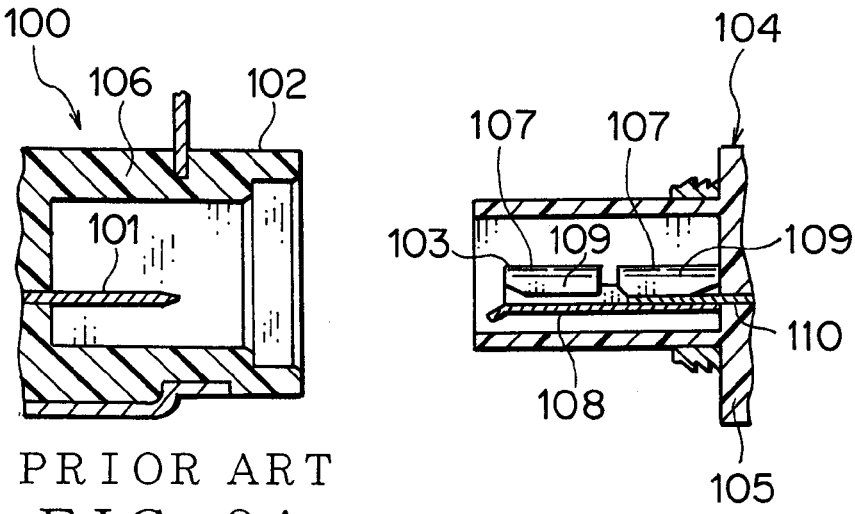
PRIOR ART FIG. 9A
FIG. 9A is a side sectional view showing primary parts of a conventional connector.
Figure 9B:
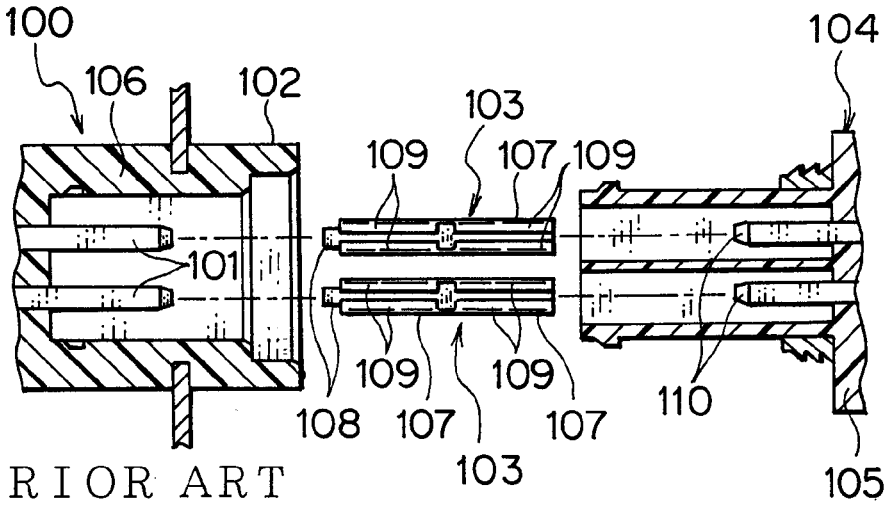
PRIOR ART FIG. 9B
FIG. 9B is a horizontal sectional view showing the primary parts of the conventional connector.
Figure 7:
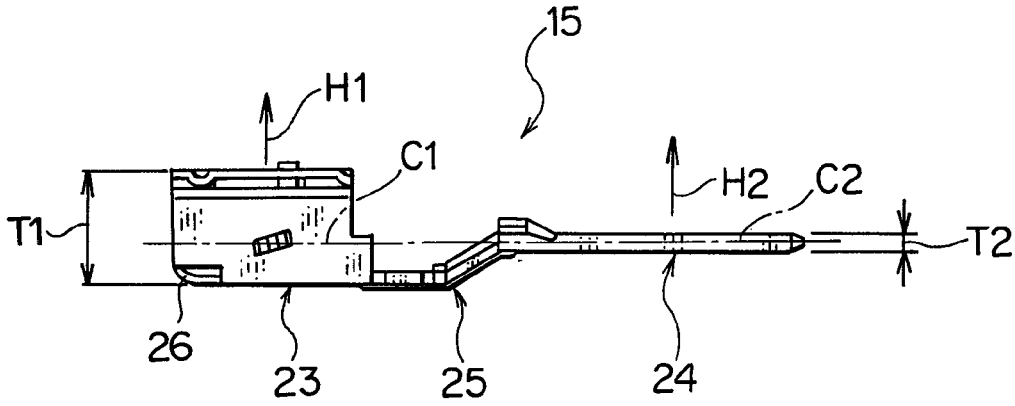
FIG. 7 is a side view showing the junction terminal of FIG. 4.

The junction terminal 15 is made from an electrically conductive metal plate. As illustrated in FIGS. 4, 5 and 7, the junction terminal 15 has a female contact portion 23, a male contact portion 24, and a bridging portion 25 which are unitarily formed with each other. As shown in FIGS. 4 and 6, the female contact portion 23 has a barrel 26 and a resilient piece 27.

The resilient piece 27 is within the barrel 26 and resiliently urges the pin terminal 6 inserted into the barrel 26 against an inner surface of the barrel 26. That is, the resilient piece 27 resiliently urges the pin terminal in a direction along an arrow head H1 shown in FIGS. 4 and 6. This electrically connects the female contact portion 23 to the pin terminal 6.

The male contact portion 24 is configured in a plate shape and is inserted into the barrel 12 of the electrical contact portion 11 of the receptacle terminal 9 to electrically connect to the receptacle terminal 9. The male contact portion 24 is resiliently urged by the resilient piece 13 of the receptacle terminal 9 in a direction along an arrow head H2 shown in FIGS. 4 and 7.

The bridging portion 25 is defined in a plate contiguous with both the barrel 26 of the female contact portion 23 and the male contact portion 24 to connect the female contact portion 23 with the male contact portion 24. In FIGS. 4 and 7, a first longitudinal line C1 passes an intermediate point of a depth T1 of the female contact portion 23, while a second longitudinal line C2 passes the middle of a thickness T2 of the male contact portion 24. The bridging portion 25 positions the female contact portion 23 and the male contact portion 24 such that the first longitudinal line C1 extends to align with the second longitudinal line C2.

In the illustrated example, the first longitudinal line C1 does not pass the middle of the depth T1 of the female contact portion 23, while the second longitudinal line C2 passes the middle of the thickness T2 of the male contact portion 24. The bridging portion 25 extends toward the male contact portion 24 so as to incline inward relative to the barrel 26 of the female contact portion 23.

The depth T1 of the female contact portion 23 in measured in the direction H1, while the thickness T2 is measured in the direction H2.

The junction terminal 15, which are accommodated in the terminal chamber 20 as illustrated in FIG. 3, has the female contact portion 23 positioned in a side of the one opening 18*a* and the male contact portion 24 positioned in a side of the other opening 18*b*.

The positioning piece 16 is made of an insulating synthetic resin material and is defined in a plate shape. As illustrated in FIGS. 2 and 3, the positioning piece 16 is formed with a plurality of terminal through holes 28, the number of which is the same as the junction terminals 15 accommodated in the connector housing 14. A cross section of the male contact portion 24 of the junction terminal 15 fits in the terminal through hole 28, but the male contact portion 24 can pass through the terminal hole 28.

The positioning piece 16 is inserted into the connector housing 14 from the other opening 18*b*. The positioning piece 16 has a locking piece (not shown) engaged with an inner surface of the connector housing 14. The engagement of the locking piece with the inner surface of the connector housing 14 fits the positioning piece 16 on the connector housing 14.

The male contact portion 24 of the junction terminal 15 is inserted into the terminal through hole 28 of the positioning piece 16, which positions the junction terminal 15 relative to the connector housing 14.

The sealing member 17 is a ring made of a resilient synthetic resin material like a rubber. The sealing member 17 is engaged on an outer surface of the main body 18 and positioned between an outer surface of the case 5 and the flange 19 to accomplish watertightness therebetween.

For assembling the connector 1 of the embodiment, first, the junction terminal 15 is inserted into the terminal chamber 20 such that the female contact portion 23 is positioned in a side of the one opening 18*a* while the male contact portion 24 is positioned in a side of the other opening 18*b*. Then, through the other opening 18*b*, the positioning piece 16 is inserted into the main body 18 of the connector housing 14 and each terminal through hole 28 receives the male contact portion 24 of each junction terminal 15. Next, the locking piece of the positioning piece 16 is engaged with the inner surface of the main body 18 of the connector housing 14, and the sealing member 17 is engaged with the outer circumferential surface of the main body 18 of the connector housing 14 adjacent to the flange 19 in a side of the one opening 18*a* to complete the connector 1.

Thus assembled connector 1 is partially inserted into the case 5. That is, the main body 18 of the connector housing 14 is partially inserted into the case 5 through the connector insertion recess 7 with the one opening 18*a* of the main body 18 headed for the case 5. As illustrated in FIG. 3, the pin terminal 6 disposed in the case 5 is inserted into the barrel 26 of the male contact portion 24 of the junction terminal 15 and is resiliently urged by the resilient piece 27 in a direction of the arrow head H1. This electrically connects the pin terminal 6 to the junction terminal 15. The flange 19 lays on an outer surface of the case 5 and the through hole 21 aligns with the threaded hole 8. Through the hole 21, the bolt 22 is screwed into the threaded hole 8 to secure the connector 1 on the case 5 of the motor 2. Thereby, the sealing member 17 accomplishes watertightness between the case 5 and the connector housing 14.

Then, through the other opening 18*b*, the connector 4 of the wiring harness 3 is inserted into the main body 18 of the connector housing 14. Thereby, as illustrated in FIG. 8, the male contact portion 24 is inserted into the barrel 12 of the electrical contact portion 11 of the receptacle terminal 9 and is resiliently urged by the resilient piece 13 in a direction of the arrow head H2. This electrically connects the junction terminal 15 to the receptacle terminal 9 while the connector housings 10 and 14 engage with each other. Accordingly, thus configured connector 1 electrically connects the wiring harness 3 with the motor 2 that is an electric instrument.

In the embodiment, the junction terminal 15 has the pair of the female contact portion 23 and the male contact portion 24. The female contact portion 23 connects to the pin terminal 6 of the motor 2 while the male contact portion 24 connects to the receptacle terminal 9 of the connector 4 of the wiring harness 3, which electrically connects the motor 2 with the wiring harness 3. Thus, no electrically conductive components are required substantially except the junction terminal 15 to electrically connect the motor 2 with the wiring harness 3. This is advantageous to decrease electrical parts in number, allowing a decreased assembling man-hour and a decreasing cost thereof.

Furthermore, the male contact portion 24 of the junction terminal 15 is correctly positioned by the positioning member. The male contact portion 24 resiliently deflects little when the male contact portion 24 of the junction terminal connects to the receptacle terminal 9 of the wiring harness connector 4.

Thus, the male contact portion 24 will keep a correct alignment during connection of the male contact portion 24 with the receptacle terminal 9 of the wiring harness connector 4. This enables correct connection between the male contact portion 24 and the receptacle terminal 9 of the wiring harness connector 4, allowing reliable electrical connection between the motor 2 and the wiring harness 3.

Moreover, the first longitudinal line C1 passing an intermediate point of the depth T1 of the female contact portion 23 aligns with the second longitudinal line C2 passing the middle of the thickness T2 of the male electrical contact portion 24. This allows a correct alignment when the male electrical contact portion 24 connects to the receptacle terminal 9 of the wiring harness connector 4. The connector 1 and the junction terminal 15 can reliably connect the motor 2 with the wiring harness 3.

In addition, when a plurality of the junction terminals 15 are arranged in a direction along the depth T1 or thickness T2 within the connector housing 14, a smaller space is required to allow a compact design of the connector housing 14.

In the present invention, the first longitudinal line C1 may pass not the middle but an intermediate point of the depth T1 of the female contact portion 23, and the second longitudinal line C2 may pass not the middle but an intermediate point of the thickness T2 of the male contact portion 24.

In the embodiment, the motor 2 is described as an electric instrument, but an electronic control unit may be selected as such an instrument. In this case, the connector 1 is attached on a case of the electronic control unit, and the case has a pin terminal that is connected to the junction terminal 15.

In the embodiment, a plurality of the junction terminals 15 are disposed laterally in the connector housing 14, but the connector housing 14 may accommodate the terminals along a direction of the arrow head H1 or H2 perpendicular to a longitudinal direction of the junction terminal 15.

What is claimed is:

1. A junction terminal accommodated in a connector housing to connect a pin terminal fitted on a case of an electric instrument with a receptacle terminal of a wiring harness connector, the junction terminal comprising:

a female electrical contact portion to electrically connect with the pin terminal of the electric instrument, a male electrical contact portion to electrically connect with the receptacle terminal of the wiring harness connector, and a bridging portion to connect the female electrical contact portion with the male electrical contact portion, the bridging portion formed unitarily with the female and male electrical contact portions, wherein the bridging portion is inclined such that a first longitudinal line passing an intermediate point of the male electrical contact portion aligns with a second longitudinal line passing an intermediate point of the female electrical contact portion, wherein the male electrical contact portion is constructed so as to be correctly positioned by a removable positioning member attached to the connector housing, the positioning member having a through hole to pass the male electrical contact portion of the junction terminal, the male electrical contact portion having a cross section that fits in the through hole to position the junction terminal in the connector housing, the positioning member having a locking piece extended at one end and engaged with an inner surface of the connector housing.

2. The junction terminal as claimed in claim 1, wherein the connector housing is secured to the case with bolts.

3. A connector comprising:

a connector housing and a junction terminal accommodated in the connector housing to connect a pin terminal fitted on a case of an electric instrument with a receptacle terminal of a wiring harness connector, wherein the junction terminal has a female electrical contact portion to electrically connect with the pin terminal of the electric instrument, a male electrical contact portion to electrically connect with the receptacle terminal of the wiring harness connector, and a bridging portion to connect the female electrical contact portion with the male electrical contact portion, the bridging portion formed unitarily with the female and male electrical contact portions, wherein the bridging portion is inclined such that a first longitudinal line passing an intermediate point of the male electrical contact portion aligns with a second longitudinal line passing an intermediate point of the female electrical contact portion, wherein the male electrical contact portion is constructed so as to be correctly positioned by a removable positioning member attached to the connector housing, the positioning member having a locking piece extended at one end and engaged with an inner surface of the connector housing.

4. The connector as claimed in claim 3, wherein the positioning member has a through hole to pass the male electrical contact portion of the junction terminal, and a cross section of the male electrical contact portion fits in the through hole to position the junction terminal in the connecter housing.

5. The connector as claimed in claim 4, wherein the connector housing is secured to the case with bolts.

* * * * *